United States Patent [19]

Wellstein

[11] 4,042,020

[45] Aug. 16, 1977

[54] POSITIVE SEAL PITLESS WELL ADAPTER

[76] Inventor: William Wellstein, P.O. Box No. 430, Fostoria, Ohio 44830

[21] Appl. No.: 660,396

[22] Filed: Feb. 23, 1976

[51] Int. Cl.[2] ..... E21B 33/03; F16L 55/00

[52] U.S. Cl. ..... 166/85; 277/101; 285/220

[58] Field of Search ..... 166/85, 88; 285/211, 285/220, DIG. 19; 277/12, 30, 115, 122, 101

[56] References Cited

U.S. PATENT DOCUMENTS

| | | | |
|---|---|---|---|
| 2,343,235 | 2/1944 | Bashark | 285/DIG. 19 |
| 2,689,611 | 9/1954 | Martinson | 166/88 |
| 2,918,972 | 12/1959 | Tubbs | 166/85 |
| 2,946,385 | 7/1960 | Dicken | 166/85 |
| 2,992,022 | 7/1961 | Risley et al. | 277/101 |
| 3,430,697 | 3/1969 | Wellstein | 166/85 |
| 3,805,891 | 4/1974 | Reinhard et al. | 166/88 |
| 3,812,910 | 5/1974 | Wellstein | 166/88 |
| 3,841,667 | 10/1974 | Sands | 285/220 |
| 3,847,217 | 11/1974 | Kramer et al. | 166/85 |
| 3,958,632 | 5/1976 | Buchman et al. | 166/85 |

*Primary Examiner*—James A. Leppink
*Attorney, Agent, or Firm*—Hugh A. Kirk

[57] ABSTRACT

This is an improvement in Wellstein's U.S. Patent No. 3,812,910 issued May 28, 1974 comprising generally: (1) a positive supporting hook for the drop pipe slide member which cooperates with the hanger member on the nipple that extends radially through an opening in the well casing; (2) an improved shaped groove for the gasket in the washer or nut for better sealing the outside of the well casing with the outside of the nipple that extends through the hole therein for withstanding higher pressures; and/or (3) the employment of a pair of gaskets inside and outside the casing surrounding the nipple and contoured to the interior and exterior walls of the casing, also for insuring better sealing.

22 Claims, 15 Drawing Figures

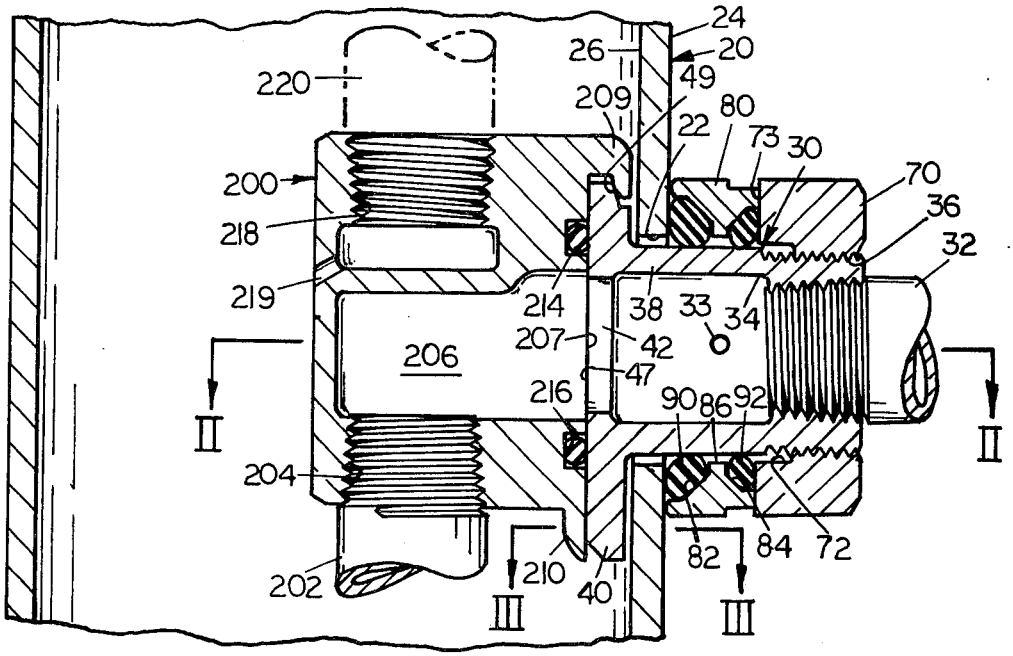
FIG. I
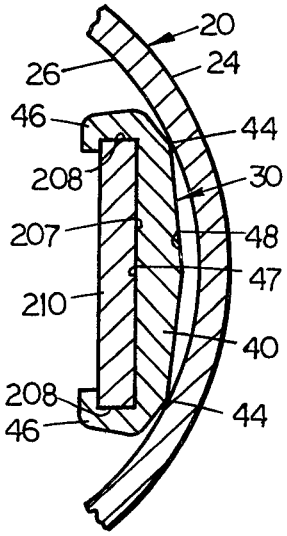
FIG. III
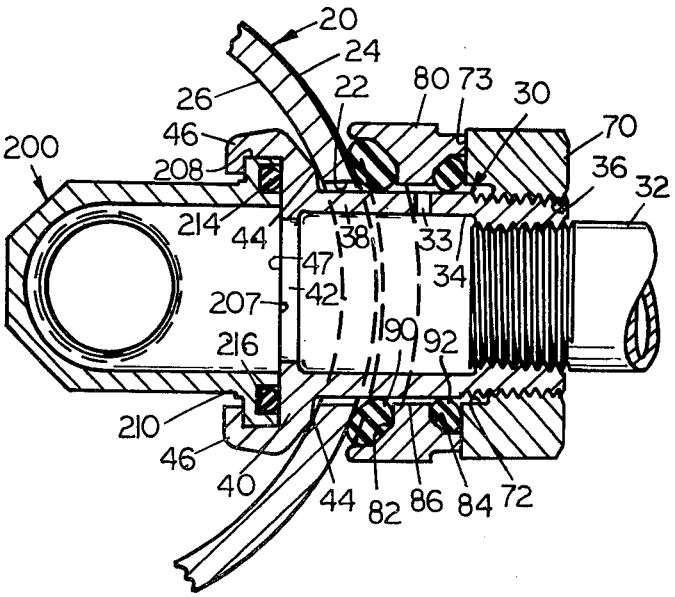
FIG. II

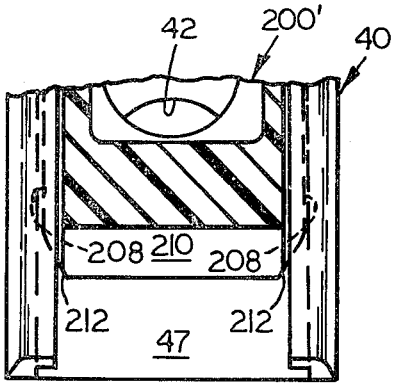
FIG. V
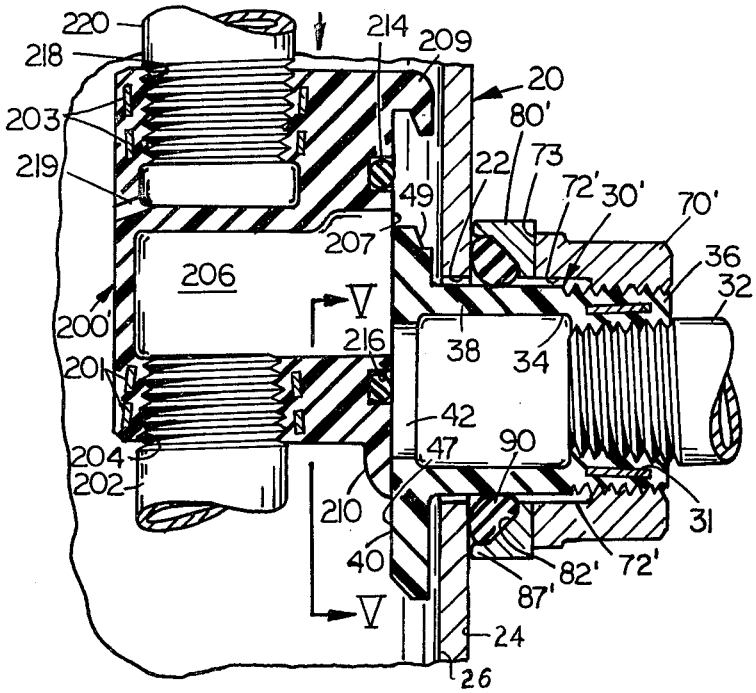
FIG. IV
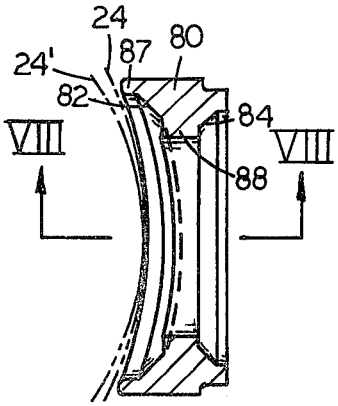
FIG. VII
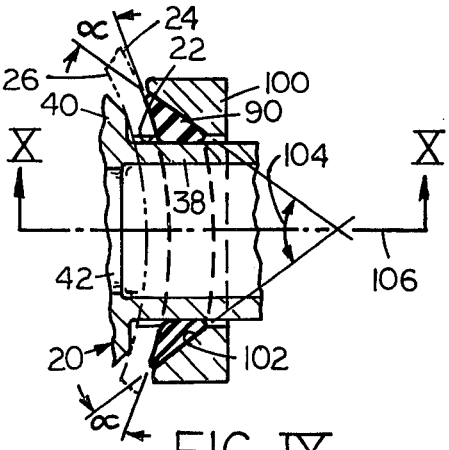
FIG. IX
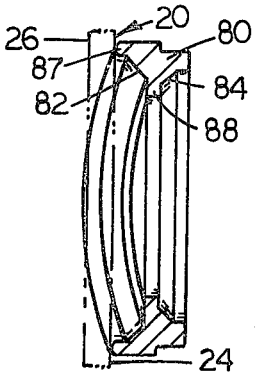
FIG. VIII
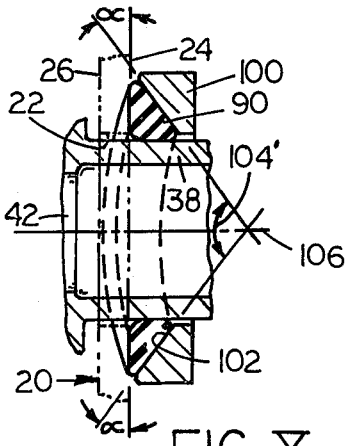
FIG. X

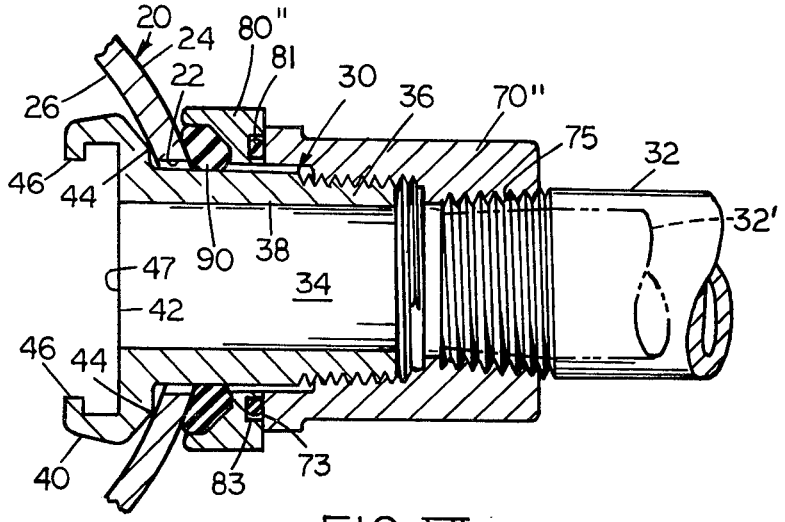
FIG. VI
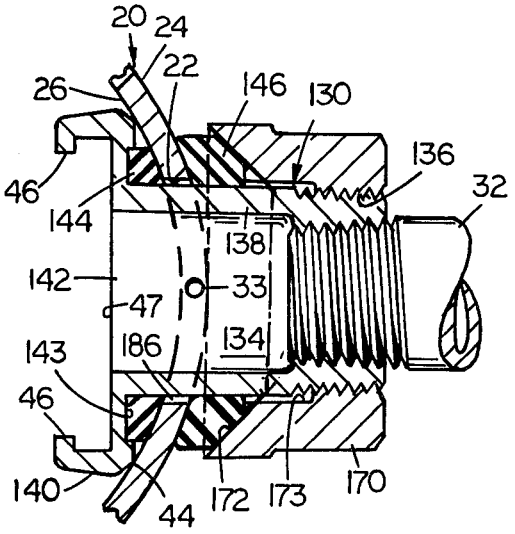
FIG. XI
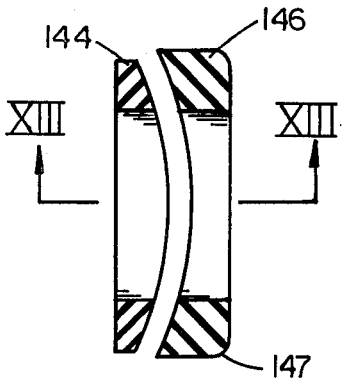
FIG. XII
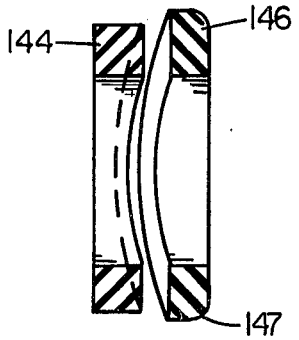
FIG. XIII

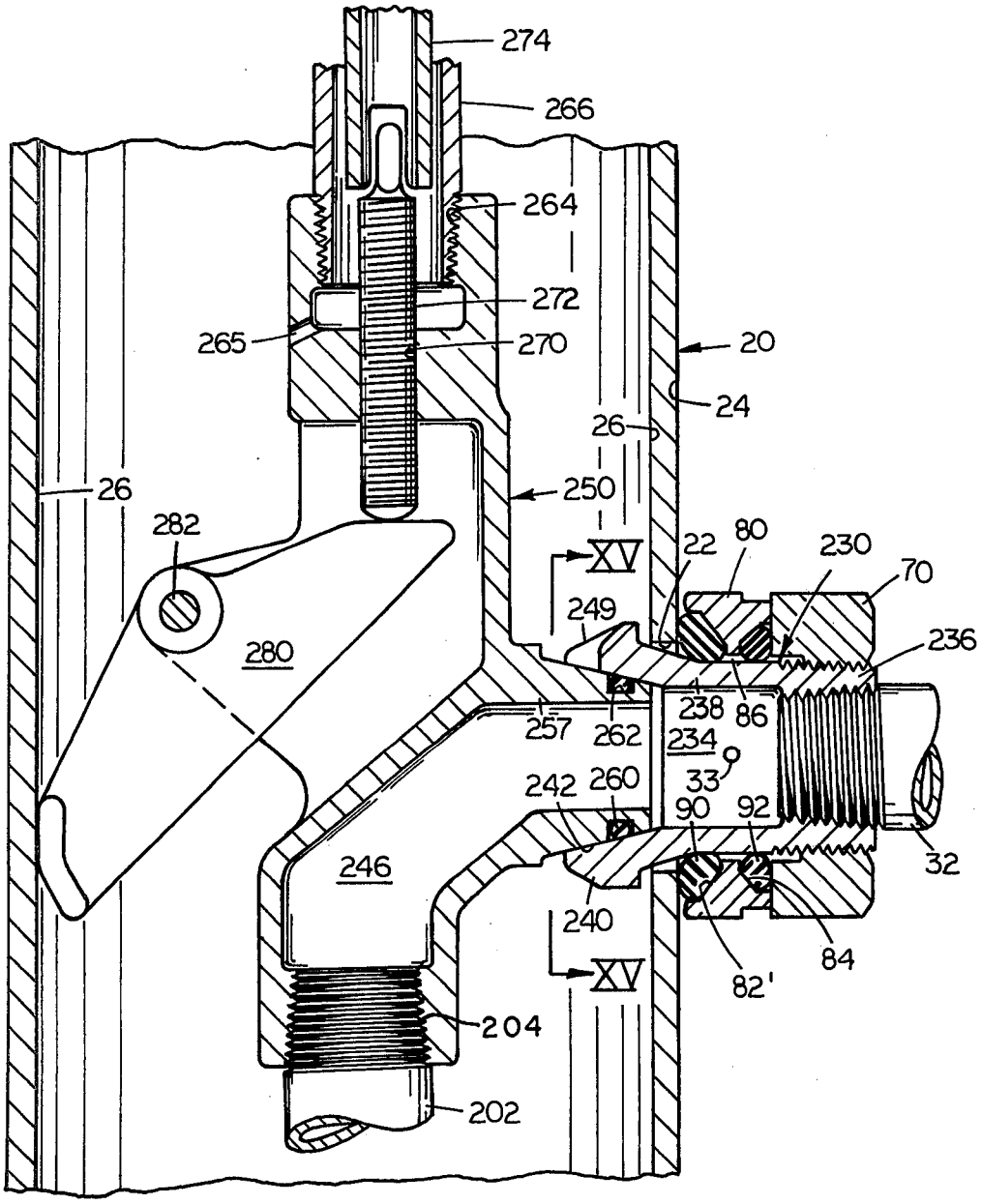
FIG. XIV
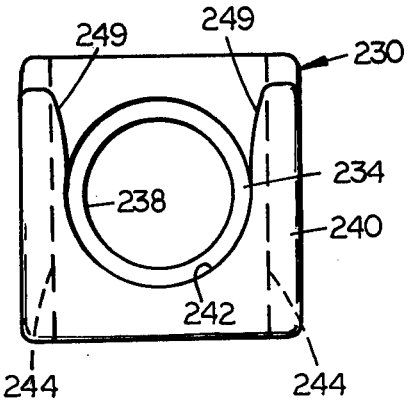
FIG. XV

POSITIVE SEAL PITLESS WELL ADAPTER

The drop pipe type slide member has an elbowed duct, one outlet of which is connectable to the drop pipe inside the well casing and the other outlet of which is provided with a gasket for sealing with the hanger member which comprises a nipple that extends through a radial hole in the casing. This hanger member has a flanged member inside the well casing larger than the hole, upon which flange member the drop pipe slide member hangs either with a positive hook over the top of its parallel sides which slide fits against the flat inner surface of the hanger flanged portion of the nipple, or by a nose which projects into the duct of that nipple.

The drop pipe member also may be provided with a drained socket for fitting an extension pipe or rod for easy insertion into a well casing, and/or may be provided with a lever for urging a nose portion into the duct of the nipple hanger member. Either or both the nipple hanger member and the drop pipe member may be made of plastic, and may have, metal reinforcing rings molded internally around their threaded portions.

The nipple portion of the hanger member has its outer end externally threaded for a nut member which may contain an internal angular groove for a gasket which presses a gasket both against the outside cylindrical surface of the nipple outside the outer wall of the casing and against that outer wall of the casing, or aganist a washer which contains another groove for a second gasket which performs the same two pressing functions. The radial cross-section of these grooves has an angular base portion so that a perpendicular line to this base of the groove will intercept, and preferably approximately bisects, the angle between the outer wall of the casing and the outer wall of the nipple, namely the angle between the two surfaces which its gasket is to seal. Thus when the gasket is compressed by this groove toward the well casing it will effectively seal against both the outside wall of the well casing and the outside wall of the nipple. In the event a washer is used between this nut and the well casing, it may have its surface towards the well casing contoured to the well casing but only contactable with the well casing on its vertical diameter. If gaskets are used in grooves on both the nut and a washer along the nipple, the space between the gaskets may be connected by an aperture through the nipple for pressurizing these gaskets.

If a gasket is used both internally and externally of the well casing around the cylindrical portion of the nipple hanger member, these gaskets have their surfaces which contact the well casing contoured to the concave inside and convex cylindrical outside surfaces of the casing. The outer end of the nipple portion of the hanger member may be internally threaded for connection to a side pipe, or the nut thereon may be internally threaded and/or externally threaded for connection to a side pipe or ducts.

BACKGROUND OF THE INVENTION

It has been found that the stop at the upper end of the drop pipe slide member shown in the positive seal pitless well adapter of Wellstein's U.S. Pat. No. 3,812,910 issued May 28, 1974 does not relieve any of the outward strain on the parallel flanges of the track on the hanger member into which it slides, particularly if this hanger member is made of plastic instead of metal.

Furthermore it has been found that relative increases in pressure in the duct through the hanger member and its nipple can cause leakage around the nipple portion of the hanger member between the gasket and the outside wall of the nipple, which leakage will prevent this adapter passing some of the State codes requiring such gaskets to be pressurized.

Accordingly, it is a purpose of this invention to improve the adapter shown in this Wellstein U.S. Pat. No. 3,812,910, and to overcome its above mentioned inadequacies.

SUMMARY OF THE INVENTION

Generally speaking the well casing side pipe adapter of this invention comprises a hanger member with a nipple portion which extends through a radial hole in the side of a vertical well casing, and an elbow duct member which connects with the hanger member. Suspending from this elbow duct member is a pipe which extends downwardly in the well casing and which pipe may support a pump at its lower end. The elbow duct may also comprise a drainable socket in its top for connecting a pipe or rod for positioning this elbow duct member with its depending pipe and pump in the well casing onto the hanger member. This positioning rod also may provide a means for operating a lever for urging this elbow member into sealable contact with the duct inside of the nipple of the hanger member. Either one or both of these adapter members may be made of plastic, and may have reinforcing steel rings embedded therein around their respective threaded portions.

Referring first to the hanger member with the nipple portion, the hanger part thereof comprises a flanged plate portion on the duct inside the well casing larger than the hole in the well casing so that this member may be clamped to the well casing by a threaded nut member on the nipple portion outside of the well casing. The surface of this plate portion adjacent the inner wall of the well casing is horizontally convex and has two vertical parallel ridges for contacting the inside vertical wall of the well casing on each side of the opening therein. Beyond these two ridges and on the other side of the plate portion are two vertical outwardly and inwardly extending flanges forming a vertical track with a continuous and uniform C-shaped horizontal cross-section, the central flat surface of which surrounds the inner open end of the duct in the nipple portion. In one embodiment the plate surface of the portion adjacent the inside wall of the well casing is provided with an annular seat around the outside of the hole in the well casing for a gasket contoured to the inside wall of the well casing.

The nipple portion of this hanger member which extends through and radially outwardly from the hole or aperture in the well casing may be internally and/or externally threaded for connecting to a side pipe, and is externally threaded at its outer end for a clamping nut which urges a gasket around the nipple portion adjacent the outside wall of the well casing surrounding the hole in the casing. The internally threaded portion of this nut is preferably stepped radially inwardly from the inner cylindrical surface thereof so that the nut can urge the gasket and/or a washer over the smooth unthreaded outer cylindrical portion of the nipple adjacent the well casing.

This gasket may take the form of a resilient plastic material, such as rubber, which may be contoured to the outer wall of the well casing, or it may have a uniform radial cross-section such as an O-ring. This gasket is seated in an annular groove in the nut or an intermediate washer which groove may be contoured to the outer wall of the well casing when a uniform radial cross-section gasket is used. An important feature of this invention is providing this groove with a beveled bottom which forms conical angle coaxial with the axis of the nipple. The beveled bottom preferably extends over a substantial portion of the base of the groove if not the whole groove, so that a perpendicular to any radial cross-section of this annular groove at about the center of the bevel will tend to bisect the angle between the outer vertical cylindrical surface of the well casing and the outer horizontal cyclindrical or conical surface of the nipple. This beveled bottom has the important advantage of pressing the gasket into tight sealing contact with both the well casing and the nipple when the gasket is moved only axially by the nut. This beveled or angular bottom to the annular groove for the gasket may be provided with axially and radially extending flange portions to provide space for the gasket to be deformed without being squeezed out of the groove. However, the outer periphera axial or horizontal flange of this groove preferably is substantially contoured to the outer surface of the well casing, but not so much that it will contact the casing other than along the vertical diameter of the flanged groove, thereby permitting the use of this adapter on various diameter well casings.

In addition to the nut there may be provided a washer which has this beveled bottom groove therein and acts as an intermediate member between the nut and the gasket against the well casing. Futhermore, the washer may have two such grooves, one at each end or side with separate gaskets for each, one between the well casing and the washer and the other between the washer and the nut, so as to form a space between the two axially spaced gaskets on the nipple outside of the well casing, which space may be pressurized by the provision of a radial hole through the nipple between these gaskets.

Referring now to the elbow member inside the well casing, this member is provided with an elbow duct, the lower vertical outlet end of which is internally threaded for the connection of a pipe, and the other horizontal outlet end of which is aligned with the inner open end of the duct in the nipple portion of the hanger member, either by a nose for insertion into this open end of the nipple member, or with a vertical flat surface with parallel edges which slides into the C-shaped cross-sectional track of the flange on the hanger member. Both horizontal outlets are provided with surrounding gaskets to seal with the hanger member. The flat slide portion is preferably provided with lower beveled corners for easy insertion into the track, and its upper end is provided with a hook type stop which hooks over the back of the top edge of the plate portion of the hanger member, which hook may have its inner surface beveled for urging this slide into intimate contact with the plate, as well as to relieve outward pressure on the inwardly extending flanges of this track.

The top of the elbow member may be provided with an internally threaded socket with a drain hole for the temporary connection of a rod or pipe for locating the elbow member and its depending pipe and pump in the well casing from the top thereof. The elbow member and preferably the one having the nose horizontal outlet, also have a lever horizontally pivoted therein, which lever is urged by a threaded bolt to press against the inside of the well casing opposite the horizontal outlet to urge the nose outlet into sealing contact with the duct in the nipple hanger member. Thus the temporary pipe for positioning the elbow member in this embodiment, also may have a central wrench means for turning the bolt to operate the lever to clamp the elbow member in position.

OBJECTS AND ADVANTAGES

Accordingly, it is an object of this invention to produce an efficient, effective, simple, economic, strong, and hermetically sealable side duct adapter for a well casing.

Another object is to produce a seal for hermetically sealing between two substantially perpendicular cylindrical surfaces of different diameters with one gasket, such as between the outside of a well casing and the outside of a nipple for a side pipe extending through an aperture in the well casing.

Still another object is to provide contoured washers around a radial aperture or hole in a well casing for sealing both the inside and outside thereof to duct means communicating with each other through said aperture.

A further object is to provide a drop pipe slide elbow member for a side adapter to a well casing which positively hooks onto the top of a hanger member to relieve strain and stress on the side rails of the track of the hanger member.

BRIEF DESCRIPTION OF THE VIEWS

The above mentioned and other features, objects and advantages, and a manner of obtaining them are described more specifically below by reference to embodiments of this invention shown in the accompanying drawing, wherein:

FIG. I is a vertical section of an improved positive sealing means for pitless well adapter according to one embodiment of this invention showing a hanger nipple member extending through an aperture in the side of a partially shown well casing, its cooperating hooked elbow duct member, and a pair of gaskets in beveled grooves on a washer around the nipple portion urged into sealing contact with the nipple, the well casing, and washer, by a nut on the nipple portion;

FIG. II is a section taken along line II—II of FIG. I showing the C-shaped slide connection between the elbow duct member and the hanger nipple member, and the contour of the washer member with respect to the outside of the well casing;

FIG. III is a section taken along line III—III of the lower part of the plate portion of the hanger member in FIG. I showing parallel side ribs and convex surface of said plate portion adjacent the inside wall of the well casing;

FIG. IV is a vertical sectional view similar to FIG. I showing the parts being assembled and made of a reinforced plastic material, and with only one gasket around the nipple outside of the well casing;

FIG. V is a section taken along line V—V of FIG. IV showing the beveled lower corners of the slide portion of the elbow member for easy fitting into the track of the hanger member;

FIG. VI is a sectional view similar to FIG. II of still another embodiment of a nut for the nipple portion of a well adapter, which nut has two internally threaded portions, one for the nipple and the other for a different sized side pipe;

FIG. VII is a sectional view showing a washer similar to that shown in FIG. II, with a beveled groove having axial and radial flanges, the former of which avoid horizontal contact with the outer surface of different diameter well casings;

FIG. VIII is a section along line VIII—VIII of FIG. VII showing that the horizontal washer flange only can contact a well casing along its vertical diameter;

FIG. IX is a sectional view similar to FIG. VII showing another type of grooved washer for urging a gasket against the outer walls of a well casing and a nipple;

FIG. X is a section taken along line X—X of FIG. IX showing the contour of the washer with respect to the outer wall of the well casing;

FIG. XI is a sectional view similar to FIG. II of still another embodiment of a well casing slide adapter in which contoured gaskets are employed on the inside and the outside of the well casing around the nipple hanger member.

FIG. XII is a vertical section of the two contoured gaskets and in the position they are used in the embodiment shown in FIG. XI;

FIG. XIII is a section taken along line XIII—XIII of the two gaskets shown in FIG. XII; showing the relative contour of their adjacent surfaces;

FIG. XIV is a vertical sectional view similar to FIG. I of a further embodiment of this invention in which a nose is employed on the elbow member with a lever means for urging the nose into the duct of the nipple member; and FIG. XV is a vertical sectional view taken along line XV—XV of FIG. XIV showing the U-shaped saddle for guiding the nose of the elbow member into the nipple member.

DETAILED DESCRIPTION OF PREFERRED EMBODIMENTS

In the figures, the well casing 20 has a radial aperture 22, an outer cylindrical surface 24, and an inner cylindrical surface 26.

1. The Hanger Members

Each of the hanger members 30 or 30', 130 and 230 is all the embodiments shown in FIGS. I - VI, XI and XIV, respectively, has connected thereto a horizontal side pipe 32 which may be threaded internally into the outer end of the nipple portions 34, 134, and 234. These nipple portions 34, 134, 234 also are shown to have external threaded outer ends 36, 136, 236 and smooth cylindrical inner portions 38, 138, 238 which extend through the aperture 22 in the well casing 20. Inside the well casing the hanger members 30 or 30', 130 and 230 are provided with flanged portions 40, 140 and 240, respectively, having central openings 42, 142 and 242 forming the inner open end of the duct through the nipple portions 34, 134 and 234. These flange portions 40, 140 and 240 each have a diameter or periphery greater than the diameter of the aperture 22 so that they can be urged and held into intimate contact with the inner wall 24 of the well casing 20 around the hole 22.

The contact with the wall by the flange portions shaped like plates 40, 140, and 240 preferably are along two parallel rib or ridge portions 44 and 244 (see FIGS. III, VI and XV, respectively), which portions seat and maintain the open upper ends of these flange portions 40, 140 and 240 aligned for insertion of the cooperating portions of the elbow members 200, 200' and 250 as they are vertically slidable down inside the casing for connection with their hanger members 30, 30', 130 and 230.

The rib portions 44 and 144 are spaced inwardly from the outer parallel vertical sides of the plate portions 40 and 140 so that the pressing of the ribs 44 will not case inward bending and binding of the two parallel C-shaped edge flanges 46 which form a vertical parallel track for engagement of the elbow duct member 200 or 200' (described in section 3, later).

These plate portions 240, 140 and 240 also have their inner surfaces 48 (see FIG. III) convexed between the two parallel ribs 44 to add strength thereto, particularly if made of plastic, while the flat vertical surface 47 between and including its two parallel side track flanges 46, has a uniform horizontal cross-section throughout its vertical extent.

The upper or top edge of the plate 40 or 140 may have a slightly beveled inner surface 49 (see FIGS. I and IV) to provide a wedging action for the hook 209 on the elbow member 200, not only to relieve the outward tension and stress of the member 200 against the inwardly extending portions of the parallel flanges 46 of the track, but also to urge better the member 200 into intimate contact with the surface 47. While upper top edge 249 of the flange plate 240 (see FIGS. XIV and XV) may be cut away and beveled to form a U-shaped seat or saddle for guiding the insertion of the nose portion 257 of the elbow member 250 into the conical opening 242 of the inner nipple portion of the hanger member 230.

2. Nuts, Washers and Gaskets

Around the outward threaded portion 36 of the nipple portion 34 of the hanger member 30 there is provided a nut 70 or 70' (see FIGS. I, II and IV) which has a larger internal diameter unthreaded portion 72 or 72' so that its inner and pressing face 73 of the nut 70 or 70' may extend beyond the threaded portion 36 outside the nipple and over the unthreaded smooth cylindrical portion 38 of the nipple portion 34. This offset unthreaded part 72' enables the nut 70 or 70' to urge better the washer 80 or 80' and its gaskets 90 and 92 into their hermetically sealing positions, as well as to avoid damage to these gaskets by trying to urge them over the threads of portion 36.

In FIG. VI there is shown still another embodiment of a nut 70'' for a nipple 30 in which the nut 70'' extends outwardly beyond the nipple 30 and is provided with internally threaded portion 75 for the pipe 32, in the event that the pipe 32 has a larger diameter than can be threaded inside the nipple 30. On the otherhand, if the pipe 32 has a small diameter such as shown in dotted lines 32' in FIG. VI, the nut 70'' can act also as an adapter for such smaller pipes. In this embodiment it is necessary because because of the straight uncalked or undoped threaded portion 36, that this nut 70'' be sealed to the washer 80''. Accordingly the washer 80'' is provided with an O-ring type of gasket 81 seated in an annular groove 83 in its side adjacent the end of the nut 70''. However this seal may be like that for the gasket 92 in a beveled groove 84 as described below.

In FIGS. I and II the washer 80 has annular grooves 82 and 84 at each end or on each face thereof, each of which annular grooves open axially outwardly and radially inwardly and are provided with beveled bottoms. These grooves 82 and 84 provide seats for the gaskets 90 and 92, respectively, preferably resilient such as of rubber. An important feature of these grooves 82 and 84 is their beveled bottom surfaces. A perpendicular to any radial cross-section from about the center of the bevel of groove 82 substantially bisects the angle between the outer surface 24 of well casing 20 and outer cylindrical surface of the nipple portion 38; and a perpendicular to any radial cross-section from about the center of the bevel of groove 84 substantially bisects the angle between the pushing surface 73 of the nut 70 or 70' and the outer cylindrical surface of the nipple portion 38. Thus as the nut 70 or 70' is rotated to move axially towards the well casing 20, the washer 80 is similarly urged towards the well casing 20, and both the gaskets 90 and 92 are compressed, not only axially towards the radial outwardly extending surfaces 24 and 73, but also these gaskets 90 and 92 are compressed radially towards the outer cylindrical surface of the nipple portion 38. Thus these gaskets 90 and 92 insure a hermatic seal not only with the outside of the well casing 20 but also with the nipple portion 38 of the hanger member 30. This is accomplished by the beveled bottom of the respective grooves 82 and 84. Attention is called to the fact that the groove 82 also follows the contour of the outer convex cylindrical surface 24 of the well casing 20 so that the uniformly radially cross-section O-ring or gasket 90 will be uniformly compressed against all of the cylindrical convex surface 24 around the hole 22 in the well casing. This sort of contour of the groove 84 is not required for compression against surface 73 of the nut 70 or 70', in that this surface 73 is annularly flat and not cylindrical.

These two gaskets 90 and 92 which seal in spaced relationship along the smooth portion 38 of the nipple 34 outside of the well casing 20, provide a sealed off annular chamber 86. This chamber 86 may be pressurized, if desired, by the fluid in the duct of the hanger member 30 by means of a radial hole 33 communicating with this chamber 86. Thus the gaskets 90 and 92 can be pressurized when such is required by the code of certain localities.

Referring now to the embodiment shown in FIG. IV another type of washer 80' is shown with only one beveled bottom annular groove 82' for the gasket 90. In this embodiment no annular chamber 86 is provided, but a hermetic seal is obtained by the gasket 90 being urged against both the smooth outer cylindrical surface 38 of the nipple portion 34 as well as the outer cylindrical surface 24 of the well casing 20.

The grooves 82 and 84 of the washers 80 and 80' are also shown in FIGS. I, II, IV, VII, and VIII to have horizontal or axially flanged portions 87 and 87' as well as radial flange portion 88 extending from each edge of their beveled bottoms. Their flanges 87, 87' and 88 provide guarded annular spaces into which the gaskets 90 and 92 may expand without being squeezed out beyond the confines of washer 80 and 80'. Referring further to FIGS. VII and VIII there is schematically shown how the axial flange 87 never contacts horizontally the outer cylindrical surface 24 or 24' of different diameter well casings 20, but only can contact this outer cylindrical surface 24 vertically as shown in FIG. VIII. Thus the contour of the outer edge of this axial flange 87, although it is concave and approximates the convex cylindrical contour of the outer wall or surface of the well casing 20, it still is not so contoured that it would be limited in its compression against different sized wall casings, except at the two points on its vertical diameter.

Referring now to FIGS. IX and X there is shown another type of washer 100, similar to the washer 80' shown in FIG. IV, but having neither an axial nor a radial flange portion, but instead only having a gasket seat in groove 102 with a completely beveled bottom surface which bottom surface forms a variable conical angle 104, 104' with the axis 106 of the nipple portion 38 due to its contour following the cylindrical outer surface 24 of the well casing 20. For gasket 90 of uniform radial cross-section this beveled bottom groove has a constant angle $\alpha$ in all circumferential radial cross-sections with the cylindrical convex surface 24 of the well casing 20.

Referring now to a further embodiment shown in FIGS. XI, XII and XIII, there is shown a hanger member 130 which differs from the hanger members 30 and 30' by having on the inner surface of its flanged plate portion 140 an annular groove 143 providing a seat for a contoured gasket 144, which gasket 144 has its outer face contoured to the inner concave cylindrical surface 26 of the well casing 20. Then on the outside of the well casing 20, urged against its outer surface 24, there is a second contoured gasket 146, which has its outer surface contoured to the outer convex cylindrical surface 24 of the well casing 20. The other surfaces of both gaskets 144 and 146 are radially flat and fit into their respective grooves or seats 143 and 172. However, since the seat 172 is frusto-conical, the cooperating edge of the gasket 146 may be slightly beveled at 147 as shown in FIGS. XII and XIII. Also in this embodiment seat 172 is in an extension of the nut 170, thereby eliminating the washer. Also because the nut 170 has its larger inner diameter portion 173 to extend axially beyond the threads 136, this seat 172 has no radial flange portion from its beveled bottom. The beveled base of the seat 172 urges the gasket 146 not only against the surface 24 of the well casing 20, but also against an exterior surface of the smooth cylindrical part 138 of the nipple portion 130. Thus this embodiment shows a pair of gaskets 144 and 146 with non-uniform radial cross-sections which can be employed for hermetically sealing the well casing 20 to a hanger member 130. The non-uniform cross-sections of these two gaskets 144 and 146 are shown more clearly in FIGS. XII and XIII showing these gaskets only and in their relative positions before being compressed as shown in FIG. XI.

Also shown in FIG. XI is a sealed off annular chamber 186 between the two gaskets 144 and 146, which chamber 186 also may be pressurized by means of a radial hole 33 through the nipple portion 138 of the hanger member 130 as described previously with respect to the embodiment shown in FIGS. I and II. If desired, the bottom of the groove 143 for the gasket 144 also may have a beveled bottom to urge this gasket also towards the cylindrical portion 138 of the nipple, however, such a bevel is not necessary in this instance, since the gasket 144 seals with the nipple 130 through the flange extensions of the nipple portion 138 into which its seats.

3. The Elbow Member and Hook

Inside the well casing 20 there is provided on L-duct or elbow member 200, 200' or 250 shown in FIGS. I, IV and XIV, depending from which is a downwardly extending pipe 202 which may be threaded into the open lower outlet 204 of the L-duct 206 in this member 200 or 200'. The other and horizontal outlet of the L-duct 206 terminates in the first two embodiments of FIGS. I and IV in a vertical flat surface 207 with parallel vertical edges 208 forming a slide means 210 which fits into the parallel grooves or track formed by the flanges 46 of the hanger member 30, 30' or 130. The lower end of this slide means 210 may have its corners 212 beveled (see FIG. V) to facilitate fitting into the track formed by the flanges 46. The upper end of the slide means 210 is provided with a hook 209 which cooperates with the upper beveled edge 49 on the hanger member 40, not only to limit the downward movement of the elbow member 200 or 200' and to align its horizontal outlet in surface 207 with the aperture 42 of the nipple duct 38, but also to relieve strain on the inwardly extending portions of the flanges 46 and to wedge the surfaces 47 and 207 into more intimate contact with each other. This wedging also helps seal the O-ring gasket 214 seated in an annular groove 216 in the surface 207 surrounding the horizontal outlet of the L-duct 206, which groove 216 is of less depth than the radial cross-sectional diameter of the O-ring gasket 214. Thus the O-ring 214 is compressed to form a hermetic seal between the hanger member 30, 30' or 130 and elbow member 200 or 200' to prevent leakage of the fluid being conducted through the L-duct 206 and its communicating duct in the nipple portion In addition, the member 200 or 200' may be provided in its top portion with a threaded socket 218 having a drain hole 219, into which socket 218 may be temporarily connected a pipe or rod 220 for lowering the elbow duct member 200 or 200' into position as shown in FIG. IV.

Referring to FIG. IV, the hanger member 30' which corresponds to the member 30 in FIGS. I and II, is shown to be made out of a plastic material having a reinforcing metal ring 31 embedded therein around the threaded portion 36. Similarly in FIG. IV the elbow member 200', which corresponds to the elbow member 200 in FIG. I, is similarly made of a plastic material and is provided reinforcing rings 201 and 203 embedded in the socket portions 204 and 218, respectively.

The beveled bottom grooves for gaskets on nipples in side pipe adapters for well casings may also be used on other forms of adapters than that shown in the previous figures, namely, one in which the horizontal outlet of the elbow member is provided with a nose portion 257 (see FIG. XIV), similar to that shown in Wellstein U.S. Pat. No. 3,430,697, instead of the slide and track assembly as disclosed in the previous figures and shown in Wellstein's U.S. Pat. No. 3,812,910 of which this invention is an improvement. Thus in FIGS. XIV and XV is shown the hanger member 230 with its nipple portion 234 internally threaded at its outer end for pipe 32 and conically flared at its inner end 242 for receiving the nose 257 of the elbow member 250. The outer end of the nipple portion 234 is also externally threaded at 236 for a nut 70 which urges a washer 80 having beveled bottom grooves 82' and 84 to compress O-ring gaskets 90 and 92, respectively, as described in connection with FIGS. I and II. The bottom of the groove 82' preferably is beveled at a less conical angle 104 (see FIG. IX) than for the cylindrical nipple 34 because of the conical outer surface of this nipple 234. This is so that the perpendicular to this bevel will substantially bisect the obtuse angle between the conical outer surface of the nipple and the outer wall 24 of the well casing 20. Between these gaskets 90 and 92, a pressurized chamber 86 also may be provided, which chamber may communicate with the duct in the nipple portion 234 through radial aperture 33.

The enlarged or flanged inner end 240 of the hanger member 230 in this embodiment is of frustoconical shape with a beveled open top edge 249 (see FIG. XV) for its central conical inlet 242 into which the nose portion 257 of the elbow duct member 250 is inserted. This elbow member 250 has an elbow duct 246, the lower open end 204 which may be internally threaded for attachment of a pipe 202 that extends down into the well. The nose end 257 may be provided with an annular groove 262 for seating an O-ring gasket 260 that seals against the conical inlet 242 of the hanger member 230.

The top of the elbow member 250 is provided with an internally threaded socket 264 with a drain outlet 265, into which socket 264 may be threaded a lowering pipe 266. In addition thereto, there is provided centrally of this socket member 264, a threaded hole 270 for a threaded bolt 272 which may be rotated by a tubular wrench or special tool 274 which extends through the center of the lowering or positioning pipe 266. This bolt 272 operates against one end of a lever 280 pivoted at 282 to a portion of the elbow member 250. The other end of this lever 280 is urged by the rotation of the bolt 272 to engage the inner wall 26 of the well casing 20 opposite the hole 22, so as to force the nose portion 257 into intimate sealing contact in the conical inlet 242 of the hanger member 230.

Thus the improved gasket or gaskets and their beveled bottom grooves or seats can be adapted to several different types of side pipes to larger pipes such as well casing adapters in order to improve the sealing between their nipple portions and the outside of the larger pipes or well casings. Furthermore, the beveled bottom grooves for gaskets for such seals may be employed in nuts without washers, or in one or both sides of washers, without departing from the scope of this invention.

While there is described above the principles of this invention in connection with specific apparatus, it is to be clearly understood that this description is made only as a way of example and not as a limitation to the scope of this invention.

I claim:

1. In a side pipe well casing adapter comprising:

A. a well casing having a radial hole in its side,

B. a hanger member having a nipple portion extending through said hole and having a flange plate means around said hole inside said casing, C. a first pipe coupled to and extending outwardly from said nipple portion, D. an elbow member inside said casing having a slide plate means fitting to said flange plate means and sealingly connecting said elbow member to said flange plate means, E. a vertical track comprising parallel flanges along the parallel vertical side edges of one of said plate means forming a C-shaped horizontal cross-section track opening towards the other of said plate means, F. a second pipe in said casing connected to the other end of said elbow member, and G. means on said nipple portion to clamp said flange plate means against the inside of said casing and said nipple in said hole, the improvement comprising:

H. a hook means on the top of said slide plate means which extends over the top and behind the upper end of said flange plate means.

2. An adapter according to claim 1 wherein said elbow member is made of plastic.

3. An adapter according to claim 1 wherein said nipple member is made of plastic.

4. An adapter according to claim 1 wherein said nipple member and said elbow member each have at least one threaded portion around their ducts and said members are made of plastic having a metal ring molded around said threaded portion in said plastic.

5. An adapter according to claim 1 wherein said elbow member is provided with a drainable socket for attachment of an installation rod.

6. An adapter according to claim 1 wherein said elbow member is provided with lever means for urging it radially towards said hole in said well casing.

7. An adapter according to claim 1 wherein said track has a uniform horizontal C-shaped cross-section throughout its vertical extent.

8. An adapter according to claim 1 wherein said hook means and the back of said flange plate means have co-operating wedging surfaces for urging said plate means into contact with each other.

9. An adapter according to claim 1 wherein said other plate means has bevelled corners at one end thereof for easily fitting into said track.

10. An adapter according to claim 1 including gasket means for sealing said nipple portion of said hanger member to the outside wall of said casing.

11. An adapter according to claim 10 wherein said gasket means is contoured to the outer surface of said well casing.

12. An adapter according to claim 10 wherein said clamping means on said nipple has an annular groove with a bevelled bottom for said gasket means.

13. An adapter according to claim 10 wherein said clamping means includes a nut on said nipple portion for urging said gasket means into sealing the contact with both the outside wall of said casing around said hole and the outside of said nipple portion.

14. An adapter according to claim 13 including a washer around said nipple portion between said nut and said well casing and said washer has a bevelled bottom for said gasket means.

15. In a side pipe well casing adapter comprising:

A. a well casing having a radial hole in its side,

B. a hanger member having a nipple portion extending through said hole, and a flange means around said hole in said casing, said flange means having a vertical track of uniform C-shaped horizontal cross-section opening towards the axis of said casing.

C. a first pipe coupled to and extending outwardly from said nipple portion,

D. an elbow member inside said casing having a slide plate fitting into said track and sealingly connecting said elbow member to said flange means, E. a second pipe in said casing connected to the other end of said elbow member, and F. means on said nipple portion to clamp said flange against the inside of said casing and said nipple in said hole, the improvement comprising:

G. a hook means on the top of said slide plate which extends over the top and behind the upper end of said track.

16. An adapter according to claim 15 wherein said hook means and the back of said flange means having cooperating wedging surfaces for urging said elbow member into contact with said flange means.

17. An adapter according to claim 15 wherein said slide plate member has beveled corners at its lower end for easily fitting into said track.

18. An adapter according to claim 15 including gasket means for sealing said nipple portion of said hanger member to the outside wall of said casing.

19. An adapter according to claim 18 wherein said gasket means is contoured to the outer surface of said well casing.

20. An adapter according to claim 18 wherein said clamping means on said nipple has an annular groove with a beveled bottom for said gasket means.

21. An adapter according to claim 18 wherein said clamping means includes a nut on said nipple portion for urging said gasket means into sealing the contact with both the outside wall of said well casing around said hole and the outside of said nipple portion.

22. An adapter according to claim 21 including a washer around said nipple portion between said nut and said well casing and said washer has a beveled bottom for said gasket means.

* * * * *

UNITED STATES PATENT OFFICE

CERTIFICATE OF CORRECTION

PATENT NO. 4,042,020

DATED August 16, 1977

INVENTOR(S) William Wellstein

It is certified that error appears in the above-identified patent and that said Letters Patent are hereby corrected as shown below:

Column 1, line 28, change "aganist" to - - against - - ; line 51, after "casing" insert - - , - - . Column 3, line 5, after "forms" insert - - a - - ; line 21, change "periphera" to - - peripheral - - . Column 5, line 40, change "is" to - - in - - . Column 6, line 6, change "240" (first occurrence) to - - 40 - - ;

Column 9, line 18, after "portion" insert - - 34 - - .

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*